US006316869B1

(12) United States Patent
Kim et al.

(10) Patent No.: US 6,316,869 B1
(45) Date of Patent: Nov. 13, 2001

(54) SHADOW MASK IN COLOR CRT

(75) Inventors: Sang Mun Kim; No Jin Park; Myung Hoon Oh, all of Kyungsangbuk-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/292,667

(22) Filed: Apr. 16, 1999

(30) Foreign Application Priority Data

Apr. 16, 1998 (KR) ..... 98/13525

(51) Int. Cl.[7] ..... H01J 29/80; H01J 9/12

(52) U.S. Cl. ..... 313/402; 313/407; 445/47

(58) Field of Search ..... 313/402–408, 313/364; 445/47; 148/336

(56) References Cited

U.S. PATENT DOCUMENTS

| | | | | |
|---|---|---|---|---|
| 4,528,246 | * | 7/1985 | Higashinakawa et al. | 428/596 |
| 4,771,213 | * | 9/1988 | Higashinakagawa et al. | 313/402 |
| 5,256,932 | * | 10/1993 | Watanabe et al. | 313/402 |
| 5,396,146 | * | 3/1995 | Nakamura et al. | 313/402 |
| 6,060,825 | * | 5/2000 | Kim | 313/479 |
| 6,130,500 | * | 10/2000 | Park et al. | 313/402 |

FOREIGN PATENT DOCUMENTS 61 84356A 4/1986 (JP) .

* cited by examiner

*Primary Examiner*—Michael H. Day
*Assistant Examiner*—Matthew J. Gerike
(74) *Attorney, Agent, or Firm*—Birch, Stewart, Kolasch & Birch, LLP

(57) ABSTRACT

A shadow mask in a color cathode ray tube, is disclosed, formed with invar alloy thin plate with a texture which allows formation of uniform sized electron beam pass-through holes, with excellent roundness and a small etching deviation in etching, including a ratio $a_R$ of a diffraction intensity R{100} of {100} crystal planes to a diffraction intensity R{110} of {110} crystal planes being greater than unity, and a ratio $g_R$ of a sum of a diffraction intensity R{100} of {100} crystal planes and a diffraction intensity R{111} of {111} crystal planes to a diffraction intensity R{110} of {110} crystal planes being in a range 2~20, obtained from the diffraction intensity R{111} of {111} crystal planes, the diffraction intensity R{200} of {200} crystal planes, the diffraction intensity R{220} of {220} crystal planes, and the diffraction intensity R{311} of {311} crystal planes calculated based on inverse pole figure analyses in a vertical direction to a surface of a thin plate of invar alloy having iron Fe and nickel Ni as the main component.

5 Claims, 2 Drawing Sheets

SHADOW MASK IN COLOR CRT

BACKGROUND OF THE INVENTION

1. Field of the Invention

The present invention relates to a shadow mask in a color cathode ray tube, and more particularly, to a shadow mask formed with an invar alloy thin plate having a texture that allows for formation of uniform sized electron beam pass-through holes, with excellent roundness and a small etching deviation in etching.

2. Discussion of the Related Art

Referring to FIG. 1, a color cathode ray tube (CRT) is provided with a panel 1 having a fluorescent film 3 coated on an inside surface thereof, a funnel 2 having conductive graphite coated on an inside surface thereof and fusion welded to the panel 1 with fusion glass at a temperature of approx. 450° C., an electron gun 6 mounted to a neck portion 4 of the funnel 2 for emitting electron beams 5, a shadow mask 7 being a color selecting electrode supported by a frame 8 inside of the panel 1, and deflection yokes 9 mounted on an outer circumference of the funnel 2 for deflection of the electron beams. The numeral 10 denotes an inner shield.

When a video signal is provided to the aforementioned color cathode ray tube, thermal electrons 5 are emitted from cathodes in the electron gun 6 and travel toward the panel 1, while being accelerated and focused by different electrodes in the electron gun 6. In the travel, the electron beams 5 are deflected, causing changes in their travel path, by a magnetic field generated by the deflection yokes 9 on the neck portion 4 of the funnel 2, thus scanning an entire surface of the panel 1. The deflected electron beams 5 are used to represent a color as they pass through a slot in the shadow mask 7 supported from an inside frame of the panel 1 since those electron beams collide with different fluorescent films 3 on the inside surface of the panel 1, to generate light, thereby reproducing the video signal.

A rimmed steel in JIS G3141 series or an aluminum killed steel(AK steel), each being a pure iron, has been used as a material for fabricating shadow masks 7 in a color cathode ray tube. However, due to the large thermal expansion coefficients of these materials(pure steel: $11.5\times10^{-6}$ $deg^{-1}$) and because of current developments in high definition television TV technology, thermal expansion of the shadow mask 7 resulting from heat caused by collisions between the electrons emitted from the electron gun and the shadow mask causes doming, which is a color dispersion experienced when electron beams collide with a fluorescent surface corresponding to a color other than a designated color due to the thermal expansion. In order to prevent doming, an invar alloy in Fe—Ni series is used, which has a smaller thermal expansion coefficient($1.5\times10^{-6}$ $deg^{-1}$).

The shadow mask 7 is formed as follows.

A slab, formed from casting of a molten steel having an invar composition in a converter or an electric furnace, is subjected to hot rolling, annealing, acid cleaning and cold rolling, thereby forming a thin plate with a thickness of 0.1~0.5mm. In the cold rolling, a rolling process may be performed several times to achieve a desired reduction ratio. Then, an intermediate annealing process is conducted at a temperature over 800° C., where the slab is temper rolled to control the thickness and surface roughness, then annealed. The surface is cleaned and dried, a coat of photoresist is applied, exposed and developed, etched by a ferrous chloride solution, removed, cut, etc. to obtain a plate with holes.

The plate is then cleaned, dried, annealed at a temperature over 800° C., hot pressed, black iron oxide coated, weld assembled and packed, to obtain a shadow mask as shown in FIG. 1.

As the shadow mask of invar alloy has a small thermal expansion coefficient, facilitating an exact pass of the electron beams irrespective of a temperature, the invar alloy is widely used as a material of shadow masks suitable for displays of high definition TV broadcasting systems and computers which require a high definition still image. In order to obtain a high definition shadow mask of such an invar alloy, small pitched uniform holes should be formed in a shadow mask material by etching. However, despite its low thermal expansion coefficient, invar alloys are known as materials which are not etched well and which therefor present problems in obtaining uniform holes. For these reasons, the etching of invar alloy has been an important subject to be solved.

For example, Japanese laid open patent No. S61-82453 restricts the carbon content to below 0.01% and Japanese laid open patent No. S61-84356 restricts the non-metallic contents, each attempting to improve the etching property. And, Japanese patent publication No. S59-32859, Korean patent publication No. 88-102 and 87-147 and U.S. Pat. No. 4,528,246 each disclose that a shadow mask material fabricated using an invar alloy with over 35% of {100} texture, which is obtained by controlling the cold rolling and annealing in a shadow mask raw material forming process, permits good etching characteristics to facilitate formation of uniform electron beam pass-through holes, resulting in a reduction in the doming and thus improved color reproduction. However, the background invar alloy material used in these related art systems shows S, B, N impurities, even when the carbon content is below 0.01%. Since the impurities are segregated from crystal grains or exist as interstitial atoms in crystal when annealed, affecting etching, it is important to control these impurities.

A {100} crystal plane has the fastest etch rate. Therefore, if the {100} planes are concentrated on a rolled surface, the etching can be carried out efficiently. However, if the {100} crystal plane concentration is very high, the fast etching causes formation of non-round holes, particularly, if the concentration is over 90%, and the holes are formed by etching along the crystal lattice, resulting in formation of holes which are neither round nor uniform. Therefore, the 35% concentration of the {100} crystal planes disclosed by these references may not be a satisfactory crystal orientation for etching.

Japanese patent publication No. S62-229738, S62-103943, U.S. Pat. No. 4,771,213 and Korean patent publication No. 90-9076 disclose a shadow mask designed to have crystal planes with a greater a-value (a-value=I{100}I/{110}) to face the screen, where I{100} is a diffraction intensity at a {100} crystal plane and I{110} is a diffraction intensity, at a {110} crystal plane, and the g-value should be greater than 2 where g-value=I{100}+I{111} in comparison to I{110} when the I{111} is a diffraction intensity at a {111} crystal plane, i.e., g=(I{100}+)I{111}/I{110} should be greater than 2. The aforementioned patents are not necessarily teaching the correct overall distributions of the crystal planes because integrated intensities used for calculating a-, and g-values and (hkl) integrated intensities are not arithmetically related to the frequency of crystal planes, and are assessed only on a particular place of the shadow mask. That is, for example, even if crystal planes of {200}, {111}), {220} and {311} are present each by 25% on a surface of the shadow mask of invar alloy, the values of g and a may not be 2 and 1, respectively. This is because the diffraction intensity varies with a structural factor F which is indicative of the arrangement of electrons and atoms in a substance, the multiplicity factor P, temperature and absorption factors. These are generally expressed by the equation shown below.

$$I = |F|^2 \cdot P \cdot \frac{1 + \cos^2 2\theta}{\sin^2\theta\cos\theta}$$

Where, I=a relative integrated intensity(arbitrary units), F=a structural factor, P=a multiplicity factor, and θ=a Bragg angle.

According to this equation, even with a random orientation of crystal grains, the diffraction intensity at each diffraction plane is not uniform as shown in TABLE 1 below (JCPDS CARD NO. 23-297).

TABLE 1

Ratio of diffraction intensity of random distributed sample (JCPDS CARD NO. 23-297)

| (hkl) | 111 | 200 | 220 | 311 | 222 | 400 |
|---|---|---|---|---|---|---|
| intensity ratio I/Io | 100% | 80% | 50% | 80% | 50% | 30% |

Even in the case of random orientation of crystal grains, g=3.6 and a=1.6 are obtained when they are calculated according to Japanese laid open patent No. S62-229738, U.S. Pat. No. 4,771,213, Korean patent publication No. 90-9076 and Japanese laid open patent No. S62-103943. This implies that there should be more {220} crystal planes on the surface of the plate in question for g=2~3.6, i.e., there should be less {200} or {111} crystal planes. This leads to a conclusion contrary to that taught by the patents that there is an abundance of texture having many {200} crystal planes concentrated on the surface of the plate if g is greater than 2. In order to rectify this matter, the measured integrated intensity should be corrected (for example, correct to an integrated intensity of a powder sample having a random orientation of crystal grains) before use. And, though the patents teach an integrated intensity of an X-ray diffraction pattern of a crystal, the integrated intensity may not precisely represent the intensity at a crystal plane. Measurements of diffraction intensities as well as accurate analyses of crystal grain distributions for crystal planes {111}, {200}, {220} and {311} are required.

SUMMARY OF THE INVENTION

Accordingly, the present invention is directed to a shadow mask in a color cathode ray tube that substantially obviates one or more of the problems due to limitations and disadvantages of the related art.

An object of the present invention is to provide a shadow mask in a color cathode ray tube, having a particular texture of an invar alloy thin plate. For good etching, the overall texture of the invar alloy thin plate is measured by assessing pole figures of crystal planes of a face centered cubic lattice exhibited in a particular direction and the orientation distribution function (ODF) in three dimensions. Also, the inverse pole figure of the invar alloy thin plate vertical to the surface of the plate is analyzed. Thus, to obtain a good etching when the ratio of a diffraction intensity of {100} crystal planes compared to {110} crystal planes is greater than 1, a ratio of the sum of diffraction intensities of {100} crystal planes and {111} crystal planes to the diffraction intensity of {110} crystal planes is ranged 2~20, and {100} crystal plane concentration is 25~90%, thereby obtaining a shadow mask having a small etching deviation, allowing formation of uniform holes with an excellent roundness.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings. The following examples are presented for illustrative purposes only and are not intended to be particularly limitative of the present invention as claimed.

To achieve these and other advantages and in accordance with the purpose of the present invention, as embodied and broadly described, the shadow mask in a color cathode ray tube (the shadow mask being a color selecting electrode) includes a ratio $a_R$ of a diffraction intensity R{100} of {100} crystal planes to a diffraction intensity R{110} of {110}) crystal planes being greater than unity, and a ratio $g_R$ of a sum of a diffraction intensity R{100} of {100} crystal planes and a diffraction intensity R{111} of {111} crystal planes to a diffraction intensity R{110} of {110} crystal planes being in a range 2~20, obtained from the diffraction intensity R{111} of {111} crystal planes, the diffraction intensity R{200} of {200} crystal planes, the diffraction intensity R{220} of {220}planes, and the diffraction intensity R{311} of {311} crystal planes calculated based on inverse pole figure analyses in a vertical direction to a surface of a thin plate of invar alloy of iron Fe and nickel Ni as main composition, which is a raw material of the shadow mask.

It is to be understood that both the foregoing general description and the following detailed description are exemplary and explanatory and are intended to provide further explanation of the invention as claimed.

BRIEF DESCRIPTION OP THE DRAWINGS

The accompanying drawings, which are included to provide a further understanding of the invention and are incorporated in and constitute a part of this specification, illustrate embodiments of the invention and together with the description serve to explain the principles of the invention:

DETAILED DESCRIPTION OF THE PREFERRED EMBODIMENT

Reference will now be made in detail to the preferred embodiments of the present invention, examples of which are illustrated in the accompanying drawings.

Most metals have small polycrystalline grains which seldom exhibit random orientation, but exhibit a preferred orientation or texture through a plastic deformation by a hot or cold processing or a manufacturing process, such as heat treatment, which causes a crystalline structural change, with changes of mechanical, magnetic and chemical properties of the metal, particularly, in a case of a re-crystallized cubic lattice, such as a face centered cubic lattice of an invar alloy of a shadow mask material, a good etching is dependent on the orientation of the crystal. Since the etching is best performed in the {100} crystal plane, a three dimensional analysis of the crystal orientation in a material is required for exact control of the etching.

Figure 1:
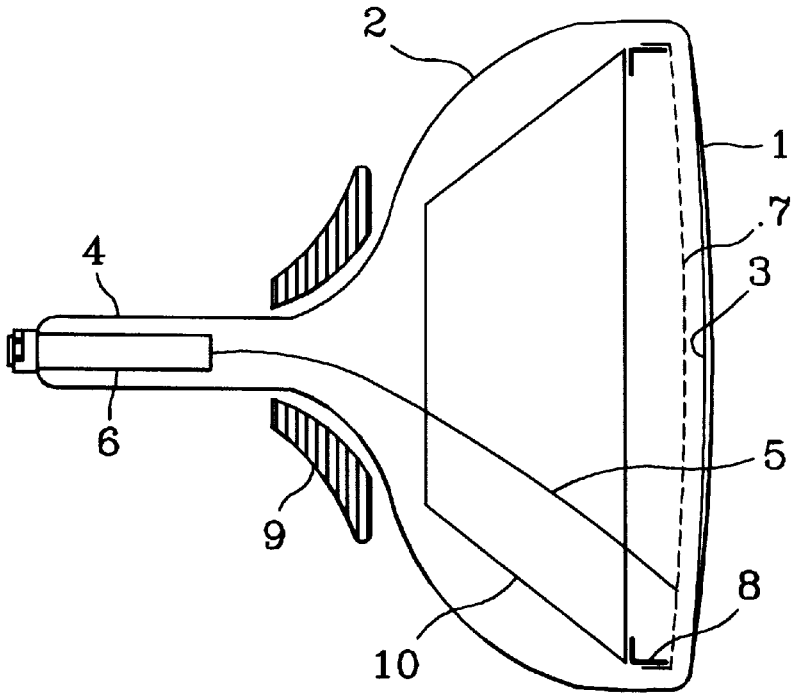
FIG. 1 illustrates a construction of a color cathode ray tube.
Figure 2:
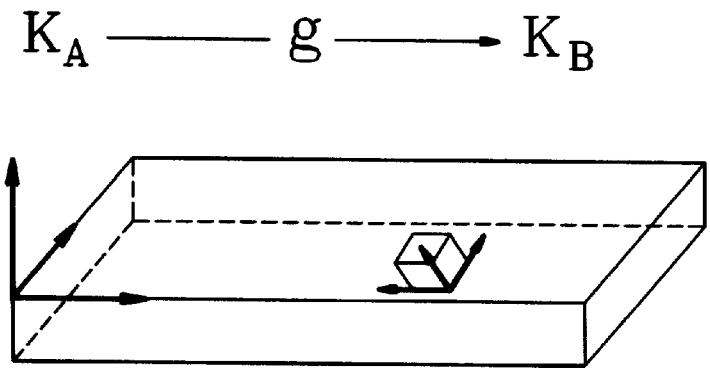
FIG. 2 illustrates relations between a crystal grain orientation and sample coordinates; and, FIG. 3 illustrates locations of orientations in an inverse pole figure.

First of all, for better understanding of the texture, it is necessary to set up a relation between the crystal orientation of each test sample and a test sample coordinate system as shown in FIG. 2 for defining a crystalline orientation. If it is assumed that a rotational orientation required for transformation of a test sample coordinate system $K_A$ to a crystal coordinate system $K_B$ is "g", the texture may be expressed as an orientation distribution function f(g), representing a volume fraction of crystals in a particular orientation "g" in the test sample as a percent of the random orientation distribution. The orientation "g" may be represented with Euler angles $\{\Phi_1, \Psi, \Phi_2\}$, or with Miller indices (hkl)[uvw]. A plate may be represented with Miller indices, setting up coordinates, with (hkl) representing for a plane parallel to a rolling plane and [uvw] representing the rolling direction.

$$f(g)_{(hkl)[uvw]} = \frac{dV(g)_{(hkl)[uvw]}/V}{dg_{(hkl)[uvw]}}$$

Where, g=($\{\phi_1, \tau, \phi_2\}$, and V is a volume of the test sample.

Figure 3:
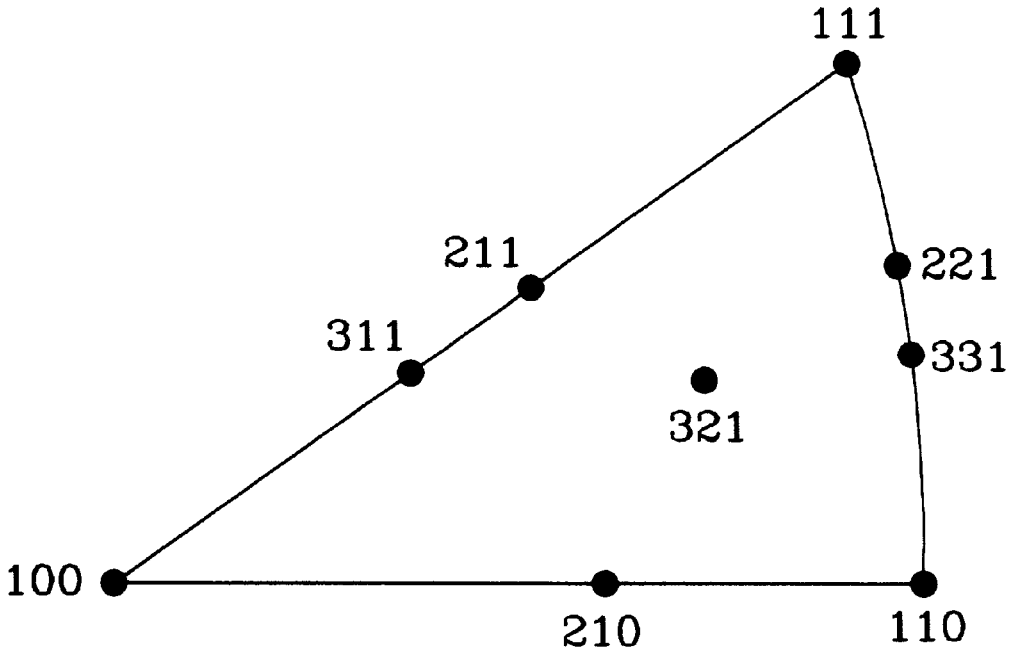

In the shadow mask, of an invar alloy of a face centered cubic lattice, four pole figures of {111}, {200}, {220}, {311} are measured, a full orientation distribution function is calculated using a harmonic method and adjusted to positive space, and diffraction intensities R{111}, R{200}, R{220}, R{311} of each of the crystal plane direction vertical to the plate surface are calculated by an equation shown below, to obtain an inverse pole figure as shown in FIG. 3.

$$R_{(hkl)} = \frac{1}{2\pi}\int f(g)d\psi$$

Where Ψ is a projected area of a crystal plane {hkl} on a particular test sample direction in an orientation space.

In the present invention, from the R{111}, R{200}, R{220}, R{311} calculated by the above equation, a good etching can be obtained in cases when a ratio $a_R$ of the diffraction intensity R{100} of {100} crystal planes to the diffraction intensity R{110} of {110} crystal planes is greater than unity, a ratio $g_R$ of a sum of the diffraction intensity R{100} of {100} crystal planes and the diffraction intensity R{111} of {111} crystal planes to the diffraction intensity R{110} of {110} crystal planes is in a range 2~20, and a concentration of the {100} crystal planes is in a range of 25%~90%, resulting in the ability to obtain a shadow mask with holes etched uniformly due to less etch deviation with uniform shape of the holes and good roundness.

$$a_R = \frac{R_{\{100\}}}{R_{\{110\}}},\ a_R \geq 1$$

$$g_R = \frac{R_{\{100\}} + R_{\{111\}}}{R_{\{110\}}},\ 2 \leq g_R \leq 20$$

$$\text{Concentration of } \{100\}(\%) = \frac{R_{\{100\}}}{R_{\{100\}} + R_{\{111\}} + R_{\{311\}} + R_{\{110\}}} \cdot 100$$

When $a_R \leqq 1$, in which there are {110} texture than {100} texture, forms of the holes formed in etching are not uniform. When $g_R < 2$, neither a uniform etching is expected, nor a rigidity of the mask is expected after the etching due to high lateral etching, and when $g_R \leqq 20$, though the holes are uniform, the roundness will not be satisfactory. And, when a concentration of the $R_{\{100\}}$ is below 25%, in which concentration of {110} texture is substantially increased, the forms of the holes are not uniform, and, when the concentration of the $R_{\{100\}}$ is greater than 90%, the holes more closely resemble a square due to a good etching in {100} crystal plane direction, leading to form non-uniform shapes of the holes on average.

The shadow mask of invar alloy of the present invention is formed as follows.

A slab of raw material, obtained as a melt in a converter or an electric furnace, cast into ingot and rolled, or by a continuous: casting, is hot rolled into an invar plate with a thickness of 2~10 mm, annealed, acid cleaned, and cold rolled into a thin plate with a thickness of 0.1~0.5 mm. In order to reduce material hardening caused by the cold rolling and to assure satisfactory flatness, the cold rolling is conducted a plurality of times, with a reduction ratio for one time of cold rolling set to be in a range of 30~50%, and the thin plate is acid cleaned and subjected to intermediate annealing at a temperature higher than 800° C. under ambient hydrogen. Then, to adjust the thickness and flatness, the plate is subjected to temper rolling with a reduction ratio set to be below 10% and annealed at a temperature ranging 600° C. 800° C. under ambient hydrogen. The surface of the plate is cleaned, dried, coated with a photoresist, developed, etched with a ferrous chloride solution, cleaned and dried to form a shadow mask with holes formed therein, annealed at a temperature ranging 800° C. 1000° C. to soften the texture, formed by pressing at 200° C. (for prevention of distortion after forming) and coated with a single coat of black iron oxide, to complete the formation of a shadow mask.

Raw materials are mixed in compositions, by weight %, of Fe 63%, Ni 36%, Mn 0.2%, Cr 0.1%, C 0.01%, Mo 0.3%, Si 0.05%, B 0.001%, Cu 0.02%, Co 0.4%, melted together to obtain an ingot, subjected to continuous hot wire drawing into 10 mm diameter wire and lengthwise forging, to obtain plate 2.0 mm thick and 100 mm thick. The plate was then subjected to hot rolling at 1200° C., continuous cold rolled plural times, annealed at 1050° C. for 2 hours in a hydrogen ambient, temper rolled with a reduction ratio of 10%, and annealed at 550° C. in a vacuum, to form a shadow mask plate material, which is then etched with a 38% ferrous chloride solution, to form electron beam pass-through holes. Changes in etchability are measured by changes in $a_R$, $g_R$ and {100} concentration(%/) under various process conditions. An embodiment of the present invention is shown in TABLE 1.

TABLE 1

| test piece | $a_R$ | $g_R$ | concentration of {100}(%) | etching factor | form of hole | roundness |
|---|---|---|---|---|---|---|
| present invention | | | | | | |
| No. 1 | 1.7 | 2.5 | 45 | 2.0 | A | 1.0 |
| No. 2 | 6.5 | 9.4 | 67.5 | 2.0 | A | 1.0 |
| No. 3 | 7.3 | 14.9 | 88.6 | 2.1 | A | 1.0 |
| No. 4 | 9.8 | 19.8 | 88.9 | 2.0 | A | 1.0 |
| comparative example | | | | | | |
| No. 5 | 0.8 | 0.96 | 19.4 | 1.4 | D | 0.86 |
| No. 6 | 0.9 | 0.95 | 21.8 | 1.5 | D | 0.92 |

TABLE 1-continued

| test piece | $a_R$ | $g_R$ | concentration of {100}(%) | etching factor | form of hole | roundness |
|---|---|---|---|---|---|---|
| No. 7 | 1.18 | 1.9 | 16.9 | 1.6 | C | 0.97 |
| No. 8 | 11.2 | 21.5 | 96.5 | 1.8 | C | 0.98 |

The above result is assessed as follows.

*Etching factor: is a ratio of the measure of the depth of the hole to the distance between a point in the middle of the hole which lies in the plane of the surace of the plate to the surface edge of the hole obtained by micrographic measurement. The etching factor was obtained from a hole etched to 150 $\mu$m formed by spray etching with a ferrous chloride solution using a photoresist pattern with a hole of 100 $\mu$m diameter at an etching condition of 42 Baume', 50° C. temperature, and 2.5 Kgf/cm$^2$ pressure of the solution concentration.

*form of the mask hole: measured by optical microscope, wherein the image was processed by an image editing computer, and given A, B, C and D, by the degree of uniformity of the mask hole. The grade A represents the good uniformity of the mask hole and the grade D represents the bad uniformity of the mask hole that cannot be used as a shadow mask. The rest of grades B and C represent midpoints between grades A and D. In the experiments, the grades A, B and D were obtained as the shapes of the mask hole.

*Roundness: a ratio of the farthest distance and the shortest distance between two parallel lines drawn tangentially to the hole in the plane of the surface of the plate.

It will be apparent to those skilled in the art that various modifications and variations can be made in the shadow mask in a color cathode ray tube of the present invention without departing from the spirit or scope of the invention. Thus, it is intended that the present invention, cover the modifications and variations of this invention and are not necessarily limited by the scope of the appended claims and their equivalents.

What is claimed is:

1. A shadow mask for a color cathode ray tube, the shadow mask being a color selecting electrode, the shadow mask comprising:

a ratio $a_R$ of a diffraction intensity R{100} of {100} crystal planes to a diffraction intensity R{110} of {110} crystal planes being greater than unity; and a ratio $g_R$ of a sum of a diffraction intensity R{100} of {100} crystal planes and a diffraction intensity R{111} of {111} crystal planes to a diffraction intensity R{110} of {110} crystal planes being in a range 2~20, wherein the $a_R$ being greater than unity and $g_R$ being in a range 2~20 are obtained from the R{111}, R{200}, R{220} and R{311}, which are diffraction intensities of each of the crystal planes in the vertical direction to the surface of the thin plate, calculated from the following equation according to inverse pole figure analyses and orientation distribution function calculation of crystal planes {111}, {200}, {220} and {311}, $$R_{(hkl)}=(1/2\pi)\int f(g)d\psi$$

where ψ is a projected area of a crystal plane {hkl} on a particular test sample direction in an orientation space.

2. The shadow mask as claimed in claim 1, wherein the shadow mask has a black iron oxide coating.

3. The shadow mask as claimed in claim 1, wherein the {100} crystal planes have a concentration of 25~90%.

4. The shadow mask as claimed in claim 1, wherein the shadow mask is formed by the following sequential steps:

A) casting of molten steel having an invar composition;

B) hot rolling;

C) annealing; and

D) cold rolling.

5. The shadow mask as claimed in claim 4, wherein the molten steel having an invar composition is acid cleaned after the annealing step (C).

* * * * *